US008986185B2

(12) United States Patent
Del Vecchio

(10) Patent No.: US 8,986,185 B2
(45) Date of Patent: Mar. 24, 2015

(54) SYRINGE CENTRIFUGE SYSTEMS

(75) Inventor: Daniel A. Del Vecchio, Wrentham, MA (US)

(73) Assignee: Lipovera, LLC, North Attleboro, MA (US)

( * ) Notice: Subject to any disclaimer, the term of this patent is extended or adjusted under 35 U.S.C. 154(b) by 1125 days.

(21) Appl. No.: 12/890,573

(22) Filed: Sep. 24, 2010

(65) Prior Publication Data

US 2011/0130263 A1 Jun. 2, 2011

Related U.S. Application Data

(60) Provisional application No. 61/245,451, filed on Sep. 24, 2009, provisional application No. 61/294,994, filed on Jan. 14, 2010, provisional application No. 61/322,277, filed on Apr. 8, 2010.

(51) Int. Cl.
*B04B 5/04* (2006.01)
*B04B 9/08* (2006.01)

(52) U.S. Cl.
CPC ..... *B04B 5/0421* (2013.01); *B04B 9/08* (2013.01)
USPC ..... 494/16

(58) Field of Classification Search
CPC ..... B04B 5/0421; B04B 9/00; B04B 9/08
USPC ..... 494/10, 20, 83–85
See application file for complete search history.

(56) References Cited

U.S. PATENT DOCUMENTS 411,570 A * 9/1889 Beimling ..... 494/20
548,717 A * 10/1895 Metzger ..... 494/20
574,933 A 1/1897 Parham
581,188 A * 4/1897 Wickson ..... 494/20
647,180 A * 4/1900 Feldmeier ..... 494/20
660,746 A * 10/1900 Bausch et al. ..... 494/20
725,832 A * 4/1903 Feldmeier ..... 74/412 R
742,801 A * 10/1903 Penn ..... 494/20
934,833 A * 9/1909 Parker ..... 494/20
950,741 A * 3/1910 Berrry ..... 494/20
995,192 A * 6/1911 Spraley ..... 494/20
1,334,109 A * 3/1920 Mojonnier ..... 494/20
1,453,802 A * 5/1923 Miller ..... 494/63
1,769,889 A * 7/1930 McClaran et al. ..... 494/20
1,991,925 A * 2/1935 Garver ..... 494/20
2,222,266 A * 11/1940 Rubissow ..... 494/37
2,820,590 A * 1/1958 Walker ..... 494/13
3,268,160 A * 8/1966 Talley ..... 494/16

(Continued)

FOREIGN PATENT DOCUMENTS

WO WO-2011/038294 3/2011
WO WO-2011038294 A2 3/2011

OTHER PUBLICATIONS

"International Application Serial No. PCT/US2010/050299, Search Report and Written Opinion mailed Feb. 25, 2011", , 13.

*Primary Examiner* — Charles Cooley
(74) *Attorney, Agent, or Firm* — Strategic Patents, P.C.

(57) ABSTRACT

A hand-cranked centrifuge is adapted for use in isolating autologous fat in injectible from. A number of syringes are hingeably coupled to a flywheel of the centrifuge. As the centrifuge turns, the syringe(s), which are supported at one end, move into a horizontal orientation and are centrifuged until the fats get separated from other liquids present in the syringes. A number of syringes, syringe holders and related devices are disclosed to accommodate centrifugation.

19 Claims, 10 Drawing Sheets

(56) References Cited

U.S. PATENT DOCUMENTS

| | | | | | |
|---|---|---|---|---|---|
| 3,460,749 | A | * | 8/1969 | Martin | 494/37 |
| 3,648,927 | A | * | 3/1972 | Abbe et al. | 494/43 |
| 3,666,171 | A | * | 5/1972 | Filz | 494/20 |
| 3,750,941 | A | * | 8/1973 | Drucker | 494/20 |
| 3,777,172 | A | | 12/1973 | Clarke | |
| 3,804,324 | A | * | 4/1974 | Sinn et al. | 494/14 |
| 4,738,655 | A | * | 4/1988 | Brimhall et al. | 494/10 |
| 4,830,530 | A | | 5/1989 | Meineke | |
| 4,894,050 | A | | 1/1990 | Kohlstette et al. | |
| 5,242,370 | A | * | 9/1993 | Silver et al. | 494/11 |
| 5,616,104 | A | * | 4/1997 | Mulenburg et al. | 482/57 |
| 5,924,972 | A | * | 7/1999 | Turvaville et al. | 494/11 |
| 6,837,843 | B2 | * | 1/2005 | Gazeau et al. | 494/10 |
| 7,488,427 | B2 | | 2/2009 | Freund | |
| 2007/0004577 | A1 | | 1/2007 | Lederer | |
| 2008/0091147 | A1 | | 4/2008 | Lee | |
| 2008/0181823 | A1 | * | 7/2008 | Iszczyszyn et al. | 422/99 |
| 2011/0130263 | A1 | * | 6/2011 | Del Vecchio | 494/9 |

* cited by examiner

SYRINGE CENTRIFUGE SYSTEMS

RELATED APPLICATIONS

This application claims the benefit of U.S. Prov. App. No. 61/245,451 filed on Sep. 24, 2009, U.S. Prov. App. No. 61/294,994 filed on Jan. 14, 2010, and U.S. Prov. App. No. 61,322,277 filed on Apr. 8, 2010. The entire content of each of the foregoing applications is incorporated herein by reference.

BACKGROUND

There remains a need for improved devices and methods for isolating autologous fat in injectible form.

SUMMARY

A hand-cranked centrifuge is adapted for use in isolating autologous fat in injectible from. A number of syringes are hingeably coupled to a flywheel of the centrifuge. As the centrifuge turns, the syringe(s), which are supported at one end, move into a horizontal orientation and are centrifuged until the fats get separated from other liquids present in the syringes. A number of syringes, syringe holders and related devices are disclosed to accommodate centrifugation.

In one aspect, a centrifuge disclosed herein includes a base plate; a gearbox coupled to the base plate that transfers rotation of a crankshaft to a driveshaft, wherein the crankshaft is a sterilizable crankshaft removably and replaceably coupled to the gearbox and wherein the driveshaft is a sterilizable driveshaft removably and replaceably coupled to the gearbox; a flywheel coupled to the driveshaft through a clutch, the flywheel having a perimeter and a plurality of attachment points distributed near the perimeter, each attachment point adapted to hingeably support a syringe in a manner that permits a rotation of the syringe radially outward from the flywheel during centrifugation; and an attachment mechanism that secures the base plate to a working surface.

The base plate may be formed of stainless steel. The gearbox may provide a gearing ratio from the crankshaft to the drive shaft of about 1:5. The centrifuge may include a display that may provide visual feedback to a user concerning operation of the centrifuge. The display may provide a numerical indication of rpm of the centrifuge. The display may be an electronic display. The electronic display may be powered by conversion of energy from the crankshaft. The display operates mechanically to provide centrifuge status information to the user. The clutch may be a free-wheeling clutch that permits continued rotation of the flywheel when the driveshaft rotates more slowly than the flywheel. The clutch may include a power take-off that prevents the centrifuge from exceeding a predetermined rotational velocity.

The driveshaft may be keyed to the gearbox and secured to the gearbox with at least one of a clevis fastener and a cotter ring. The crankshaft may be keyed to the gearbox and secured to the gearbox with at least one of a clevis fastener and a cotter ring. Each attachment point of the flywheel may include a hole. The centrifuge may include a hook in each attachment point shaped to retain an end of a plunger for a syringe. The hook in each attachment point may include a lock to secure the plunger during centrifugation. The plurality of attachment points may include eight attachment points. The attachment mechanism may include a clamp. The attachment mechanism may include at least one suction cup. The flywheel may have a diameter of about 12 cm. The crankshaft may be powered by a foot pedal.

In another aspect, an apparatus disclosed herein includes an end support shaped and sized to retain a barrel of a syringe; an arm extending from the end support to a flywheel attachment shaped to secure the arm to a hole in a flywheel; and a plunger support on the arm that removably and replaceably couples to a plunger extending from the barrel of the syringe.

The plunger support may include a hook-and-loop fastener. The plunger support may include a plurality of fingers that springably engage the plunger. The plunger support may include a band with a snap to circumferentially secure the plunger. The plunger support may include a through-hole in the arm. The plunger support may include a protrusion. The end support may include a forked opening. The end support may include a hole that encircles the barrel. The end support may be shaped and sized to securely hold a 60 cc syringe barrel. The plunger support may be positioned to securely retain a plunger at an end of the plunger when the plunger may be fully retracted from the barrel.

In another aspect, a syringe disclosed herein includes a barrel having a lumen, an opening on a first end and a fluid port on an opposing end for passage of fluid into and out of the lumen; a plunger shaped to fit through the opening on the first end of the syringe, the plunger having a seal that slidably engages an interior wall of the barrel; and a lock to retain the plunger in a fixed position relative to the barrel.

The barrel may be formed of a clear plastic. The barrel may be gradated with markings that indicate volume within the lumen. The lumen may have a volume of at least 60 cubic centimeters. The opening on the first end of the barrel may include an interior rib that resists a passage of the seal out of the barrel. The fluid port may include a needle attachment. The needle attachment may be threaded. The lock may include a pin that passes through a wall of the barrel and fits into a mating hole in the plunger. The lock may include a fork that surrounds and restrains the seal of the plunger. The plunger may include a thumb rest with one or more holes for securing the syringe to a centrifuge.

In another aspect, a syringe cap disclosed herein includes an open end shaped and sized to fit about a plastic tip of a syringe; a closed end opposing the open end that retains material within the syringe when the syringe cap may be secured to the plastic tip; and a thread disposed within an interior of the syringe cap thereby providing a threaded region within the cap, the thread having a crest providing a sharp edge and sufficient hardness to cut into the plastic tip.

The syringe cap may include finger grips disposed on an outside of the syringe cap. The finger grips may include two opposing tabs. The interior may be tapered along the threaded region so that a first diameter toward the open end may be greater than a second diameter toward the closed end. The syringe cap may be formed of stainless steel.

In another aspect, an apparatus disclosed herein includes a barrier formed of a sheet of material, the barrier being a sterilizable barrier shaped and sized to fit about a gearbox of a hand-cranked centrifuge; a first opening in the barrier, the first opening positioned to receive a crankshaft for the gearbox and the first opening having a seal for the crankshaft; and a second opening in the barrier, the second opening positioned to receive a driveshaft for the gearbox and the second opening having a seal for the driveshaft.

The first opening may include a bearing to permit sealed rotation of the crankshaft. The second opening may include a bearing to permit sealed rotation of the driveshaft. The barrier may be formed of a disposable material provided for use in a sterile package. The barrier may extend a sufficient distance along a working surface for the gearbox to form a sterile barrier between the gearbox and a surrounding environment.

DRAWINGS

The foregoing and other objects, features and advantages of the invention will become apparent from the following description in conjunction with the accompanying drawings. The drawings are not necessarily to scale. Emphasis has instead been placed upon illustrating the principles of the invention. Of the drawings.

DETAILED DESCRIPTION OF THE INVENTION

Described herein are a number of syringe centrifuges and methods for using same. The methods and systems may be suitably employed in a variety of surgical augmentation procedures such as cosmetic augmentation, filling, contouring, and so forth. Still more generally, these methods and systems may be usefully employed in any procedure where fat or other substances might be usefully separated from other liquids, tissue and the like for injection or other deployment from a syringe.

In one aspect, a hand-turned centrifuge is attached directly to a plunger of a syringe through an attachment point that permits the syringe to orient radially from a flywheel during centrifugation. A lock or similar mechanism may be provided to firmly secure the plunger to the barrel of the syringe in order to prevent accidental separation and resulting loss of extracted biomaterials contained in the barrel of the syringe.

Figure 1:
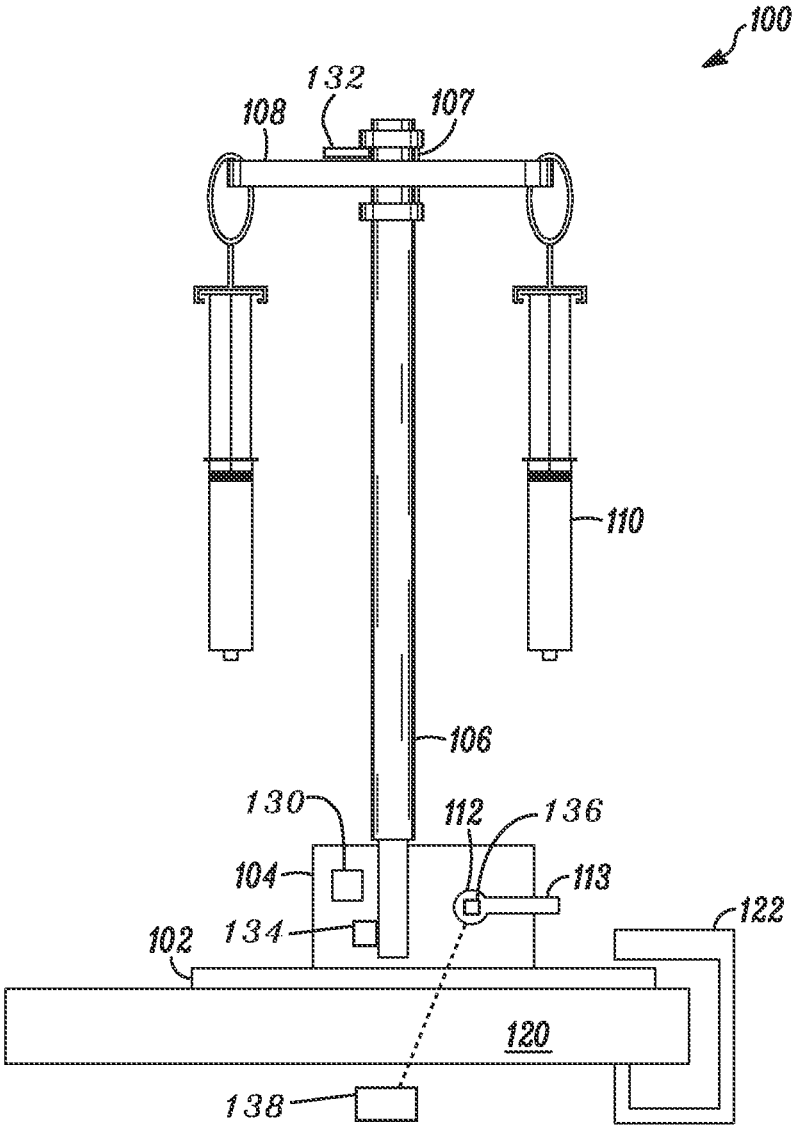
FIG. 1 shows a syringe centrifuge.

FIG. 1 shows a syringe centrifuge. In general, the centrifuge 100 may include a base plate 102, a gearbox 104, a driveshaft 106, a clutch 107, a flywheel 108, and a crankshaft 112, all as described in greater detail below. One or more syringes 110 may be attached to the flywheel 108 during use as depicted in FIG. 1.

The base plate 102 may be formed of stainless steel. The base plate may, for example be an 18 cm by 10 cm rectangle that is 1 cm thick. The base plate 102 may be secured to a working surface 120 such as a table by an attachment mechanism 122, which may include a clamp or the like to secure the centrifuge 100 during use, taking into account the rotary motion of the centrifuge 100 and any syringes 110 (and contents thereof) attached to the centrifuge 100. The attachment mechanism 122 may be adjustable to accommodate working surfaces of different shapes and thickness, and may include a quick-release or the like for easy removal of the centrifuge 100, and/or a lock or other mechanism to avoid accidental release. The attachment mechanism 122 may also or instead include suction cups 308, hook-and-loop fasteners, adhesives, nuts, bolts, screws and any other components for temporary, semi-permanent, or permanent mounting of the centrifuge 100 on the working surface 120.

The gearbox 104 may be attached to the base plate 102 using any suitable techniques. In general, the gearbox 104 may be any combination of gears and other mechanical couplings to transfer rotation of the crankshaft 112 to the driveshaft 106. This may, for example, include a right-angle gearbox with a 1:5 gearing ratio (from crankshaft 112 to driveshaft 106) such as the Groschopp Model RA3000 commercially available from Groschopp Integrated Motion Solutions. More generally, any gearing ratio and crank-to-drive angle consistent with operation of a manually-powered centrifuge as described herein may be suitably employed as the gearbox 104.

It will be appreciated that, while a hand crank provides a convenient, low-cost source of power to rotate a centrifuge, other techniques may also be employed. This may include direct sources of manual power input, such as a foot pump or pedal 138, lever, or the like through which a user can provide energy that is converted into rotation by the centrifuge 100. This may also or instead include mechanical energy storage systems such as a wind-up spring, compressed air, or the like to store manually-provided energy for use during a centrifuging operation. In another aspect, the centrifuge may be electrically powered using any of a variety of techniques. This may include a switch or the like to turn the centrifuge on, along with one or more switches, dials, or the like to control a speed of the centrifuge. Thus in one aspect the gearbox 104 and crankshaft 112 may be replaced with an electrically powered motor. This approach advantageously provides hands-free operation of the centrifuge 100 and may with suitable instrumentation permit more consistent, controllable drive speeds. On the other hand, manual operation advantageously removes any requirement for external power, and the expense of packaging electronics and related components for sterilization.

In one aspect, the gearbox 104 may establish a maximum rotational speed for the device 100, such as a target number of revolutions per minute ("rpm") or the like. In another aspect, the gearbox 104 may permit a variable top speed, which may include two or more user-selectable speeds, or a continuously variable top speed. A wide variety of gears and gear systems are known in the art, including spur gears, helical gears, double helical gears, bevel gears, hypoid gears, crown gears, worm gears, non-circular gears, rack and pinion systems, epicyclic gears, sun and planet gears, harmonic drives, and cage gears, any of which may be employed in various combinations to provide the desired gearing ratios within the gearbox and/or to provide a desired output speed or power.

In one aspect, a continuously variable transmission or the like may be employed to permit rotation of the flywheel 108 at a constant angular velocity regardless of input at the hand crank. Suitable transmissions may employee chains, pulleys, belts and so forth, such as a variable-diameter pulley drive, a toroidal or roller-based transmission, an infinitely variable transmission, a ratcheting transmission, a hydrostatic transmission, a variable toothed wheel transmission, a cone transmission, a radial roller transmission, or a traction-drive transmission. An override clutch or other mechanism may be similarly employed to limit angular velocity of the flywheel 108 independently from a speed at which the hand crank 112 is rotated.

Other gears, clutches, bearings and the like may also be employed to change the direction, speed, orientation or the like of rotational energy provided from the hand crank 112, as will be readily appreciated by one of ordinary skill in the art, and all such variations are intended to fall within the scope of this disclosure. Similarly, a brake or the like may be provided to stop or slow rotation of the centrifuge during or after use.

The driveshaft 106 generally serves to drive the centrifuge 100. The driveshaft 106 may be coupled to the crankshaft 112 through the gearbox 104. The driveshaft 106 may, for example, include a 40 cm length of 15 mm stainless steel or other material. The driveshaft 106 may have a bottom end that reduces to about 11 mm or any other suitable diameter to fit into the gearbox 104, where the driveshaft 106 may be keyed to rotationally engage a corresponding opening in the gearbox 104. The driveshaft 106 may be secured to the gearbox 104 with a drive shaft fastener 134 such as a clevis fastener, cotter pin, circle cotter, split pin, or any other suitable fastener. The driveshaft 106 may also or instead use a friction fit to engage the gearbox 104. The driveshaft 106 may be removably coupled to the gearbox 104 to permit cleaning, storage, and the like. A lip may also be provided to stop the driveshaft 106 at a predetermined depth into the gearbox 104 during insertion. A bearing or the like may also be provided to relieve friction between the lip and the top of the gearbox 104. The crankshaft 112 may be keyed to the gearbox and secured to the gearbox with a crankshaft fastener 136 such as at least one of a clevis fastener and a cotter ring.

The clutch 107 may be attached to a top end of the driveshaft 106. The clutch 107 may be keyed to the driveshaft 106 and secured using cotter rings or the like. Washers, pressure clips, and the like may be used to more securely fasten the clutch 107 to the driveshaft 106, or the clutch 107 may be permanently attached to the driveshaft 106 using a welded joint or the like. In this latter arrangement, the clutch 107 may be preferably sealed in a manner that permits sterilization of the clutch/driveshaft arrangement. The clutch 107 may serve a variety of functions in the centrifuge 100. For example, the clutch may provide free-wheeling rotation of the flywheel 108 in one direction so that the driveshaft 106 applies rotational force to the flywheel 108 when turning faster than the flywheel 108, and the flywheel 108 can spin freely when the driveshaft 106 is turning more slowly. Thus the crankshaft 112 can decouple from the flywheel 108 after a desired rate of rotation is achieved. One suitable clutch is the Sprag Clutch, Model FN400 (15mm), commercially available from the GMN Bearing Company. The clutch 107 may also or instead include a power take-off 132 that decouples the driveshaft 106 from the flywheel 108 after a certainly rotational speed has been achieved. This advantageously produces a consistent top speed for the centrifuge 100 to relieve an operator from determining or estimating an appropriate rotational velocity for centrifugation. The power take-off 132 may be used in the clutch 107 addition to or instead of the free-wheeling mechanism described above, or various functions of the clutch 107 may be instead realized within the gearbox 104 as generally discussed above.

The crankshaft 112 may be formed of stainless steel or other suitable material and extend horizontally or in any other useful orientation from the gearbox 104. The crankshaft 112 may, for example, be fashioned from a 25 cm length of 15 mm diameter stainless steel. The crankshaft 112 may be reduced to, e.g., 14 mm and keyed on one end (an "insertion end") for insertion into and engagement with the gearbox 104 in any manner similar to the driveshaft 106 as discussed above. The crankshaft 112 may be removable to permit cleaning, sterilization, storage, transportation, and so forth. An opposing end or "handle" end may have a handle 113 permanently attached (e.g., with a welded joint, epoxy, or the like), or removably attached to permit further disassembly. The handle may include a bearing or the like to permit for convenient orientation and gripping while the crankshaft 112 is turned.

The centrifuge 100 may include a display 130 that provides visual feedback to a user concerning operation of the centrifuge 100. This may, for example, include an indication of the current rpm of the centrifuge 100 and/or whether the centrifuge 100 is rotating at an appropriate speed for centrifugation. In one aspect, the display 130 may be an LCD, LED or other electronic display that provides a numerical indication of rpm, or other useful information, such as whether the speed is correct (which may be a simple LED indicator or the like), a dynamic bar or the like that moves according to a current speed, or an indication of whether to increase or decrease cranking speed. In one aspect, the electronic display may be powered by conversion of energy from the crankshaft 112 for the centrifuge 100. In another aspect, the display 130 may operate mechanically or electro-mechanically using any suitable techniques to provide centrifuge status information to a user.

The flywheel 108 is coupled to the clutch 107 and/or driveshaft 106 to transfer rotational power from the driveshaft 106 to the flywheel 108. The flywheel is described in greater detail below.

Figure 2:
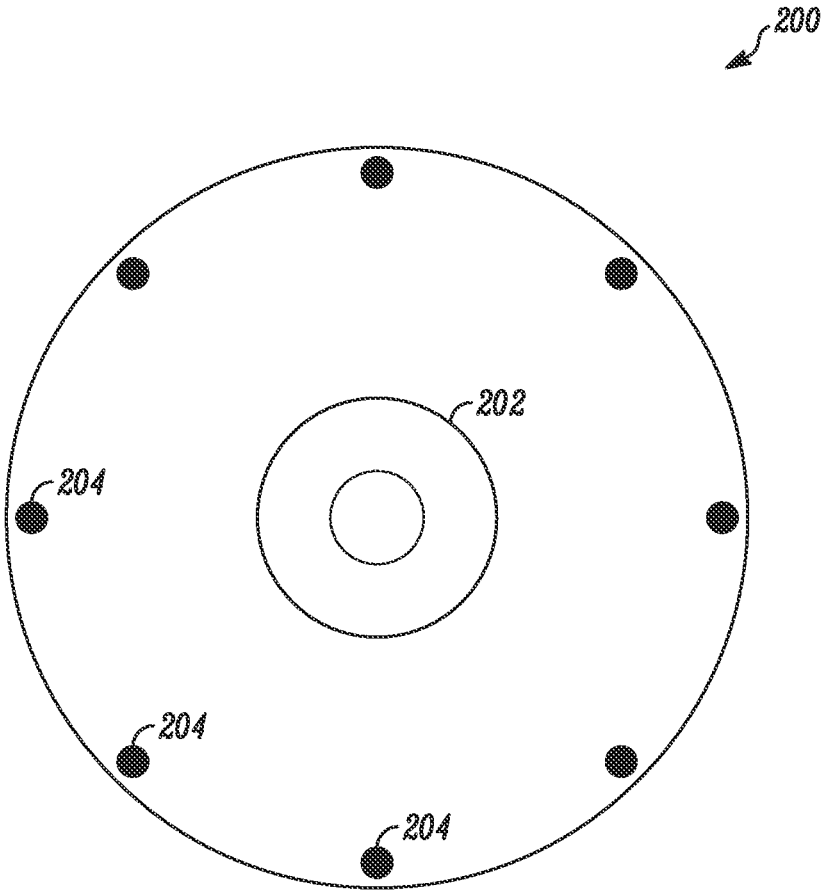
FIG. 2 shows a top view of a flywheel for a syringe centrifuge.

FIG. 2 shows a top view of a flywheel 200 for a syringe centrifuge. The flywheel 200 may include a clutch 202 as generally described above that secures the flywheel to a driveshaft, which may be any of the driveshafts described above. A number of attachment points 204 may be distributed near the perimeter of the flywheel 200 for coupling to syringes (not shown). The flywheel 200 may have any dimensions suitable for centrifuging syringes as generally contemplated herein. The flywheel 200 may, for example, be formed of stainless steel with a thickness of about 1 cm and a diameter of about 12 cm, or any other suitable dimensions. For eight attachment points 204, the attachment points 204 may be evenly spaced at about 0, 45, 90, 135, 180, 270, and 315 degrees about a center of the flywheel 200. In one embodiment, the flywheel 200 may be shaped and sized to hold up to eight 60 cc syringes and spin at about 300-400 revolutions per minute under power of the driveshaft.

More generally, the flywheel 200 may be fabricated from a variety of materials, and may provide a variety of mechanisms for hingeably connecting one or more syringes thereto. In one aspect, the flywheel 200 may have sufficient mass to maintain balanced rotation substantially independent of the mass of one or more syringes attached thereto. Where the mass of the flywheel 200 is lower, syringes may be preferably attached at radially opposed locations in order to balance rotation of the flywheel 200. In addition, one or more removable and replaceable weights may be provided on the flywheel 200 to balance rotation after one or more syringes have been attached. Similarly, one or more movable/slidable weights may be mounted to the flywheel 200 to permit adjustable balancing as syringes are added to and removed from the flywheel 200. These weights may, for example, slide from a center of the flywheel 200 toward a perimeter of the flywheel 200 to counterbalance syringes as appropriate. These movable weights may slide between two or more fixed positions (that may be located with tactile feedback, alignment guides, or the like) or may be continuously adjustable to permit user-customizable adjustments according to syringe size, observed balance, and so forth.

In one aspect, the flywheel 200 includes holes or the like to accommodate hooks or other attachment points for syringes. The attachment point(s) may permit rotation of the attached syringe radially outward from the flywheel using, e.g., a suitably oriented hook/loop in a hole, a hinge, a universal coupling (e.g., a ball in a socket) or any other suitable mechanical coupling or combination of couplings. By permitting syringes to swing freely and radially from the flywheel 200, each syringe is able to rotate during centrifugation into alignment, or substantially close to alignment, with the outward force of centrifugation. As rotational velocity decreases, the syringes can then return to an orientation that preserves a separation of centrifuged substances by operation of gravity.

Figure 3:
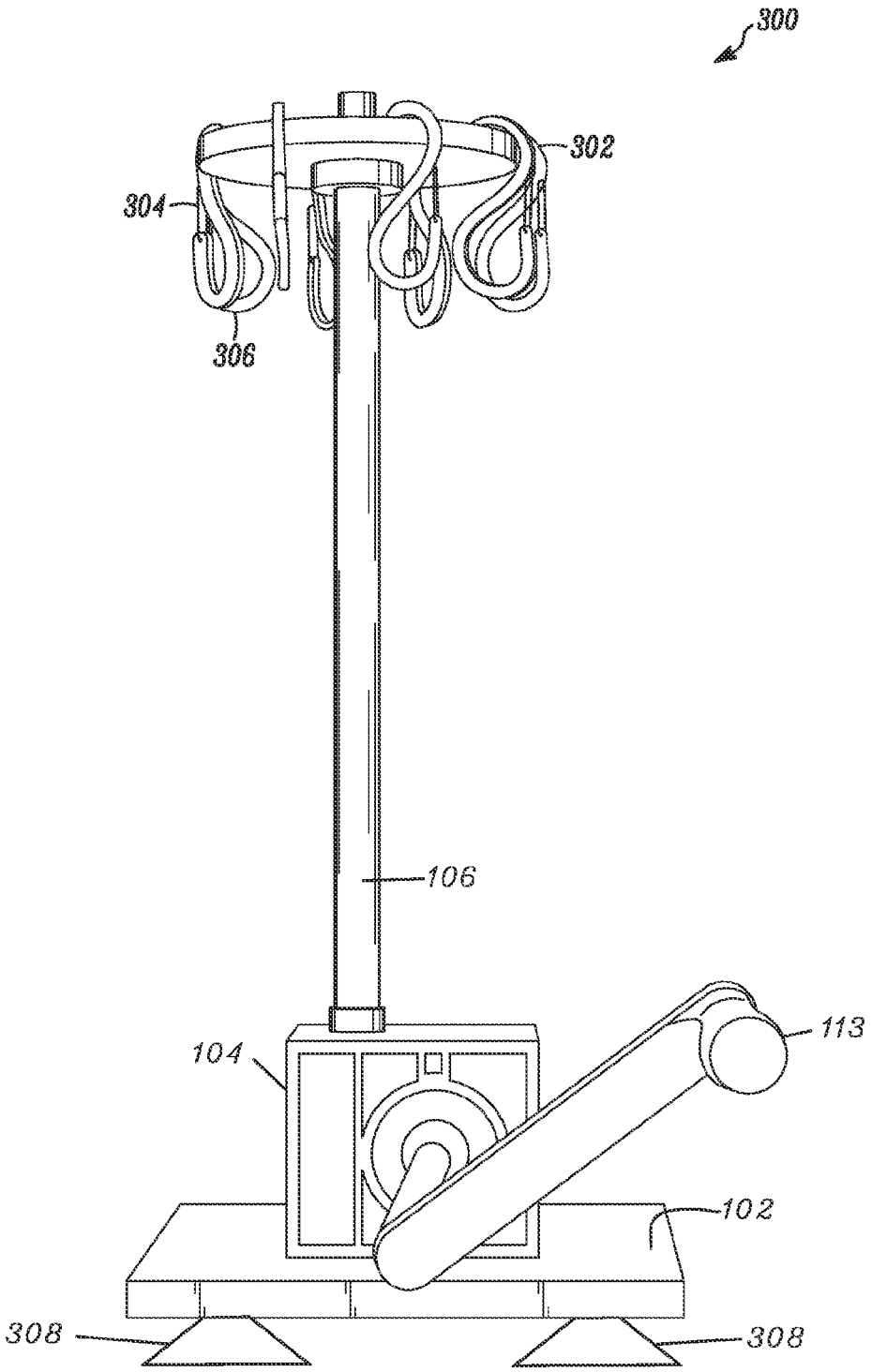
FIG. 3 is a perspective view of a syringe centrifuge.

FIG. 3 is a perspective drawing of a syringe centrifuge. The centrifuge 300 may, for example be any of the centrifuges described above. As depicted in FIG. 3, the flywheel 302 of the centrifuge 300 may have a number of hooks 304 or similar attachment points for syringes. Each hook 304 may have a syringe retainer 306 such as a number of fingers or a circular hole to receive and hold a flanged end of a syringe plunger. Each hook 304 may include a locking mechanism that securely engages and retains the plunger until actively released. A variety of spring-actuating and other locking mechanisms suitable are known in the art that may be suitably adapted to securely retaining a syringe plunger as contemplated herein. The hooks 304 may be coupled to the flywheel 302 in a manner that permits rotation away from an axis of the driveshaft during centrifugation as described above. The shape and size of each syringe retainer 306 is not important except that the syringe retainer 306 should be capable of retaining a syringe under the forces of centrifugation expected during use. In one aspect, there is disclosed herein a syringe centrifuge that secures syringes by a plunger end (e.g., from the hooks 304) in a manner that permits rotation to a horizontal orientation during centrifugation.

Figure 4:
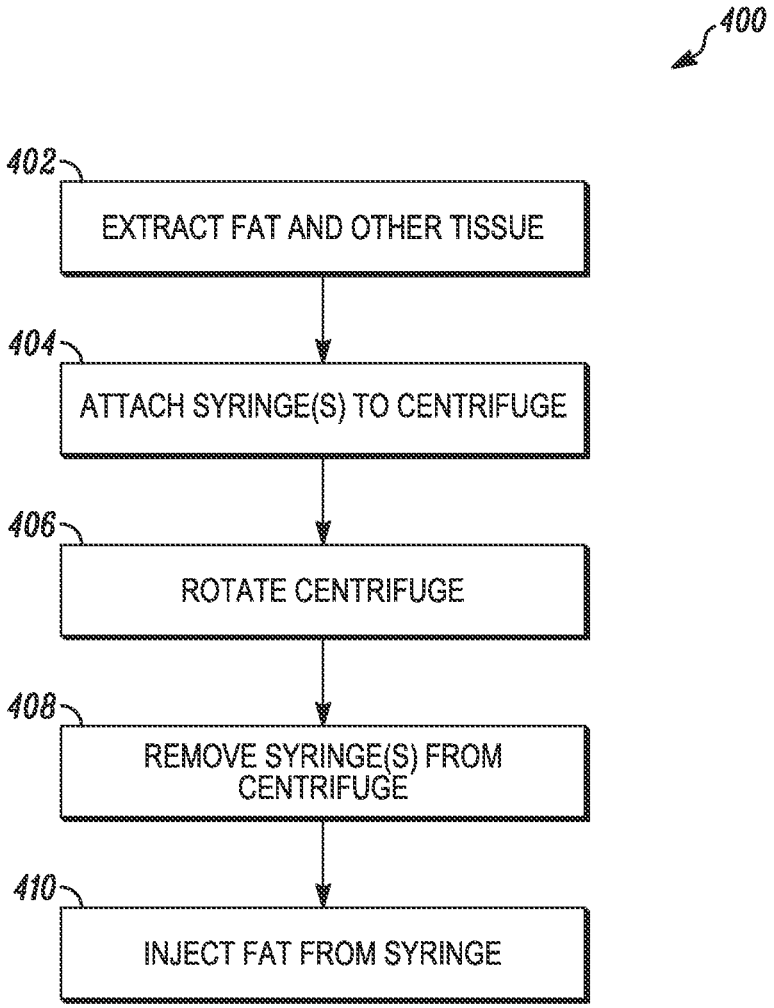
FIG. 4 shows a method for using a syringe centrifuge.

FIG. 4 shows a method for using a syringe centrifuge. The method 400 may begin with extracting fat and other liquid/tissue from a donor site as shown in step 402. The fat may, for example, be autologous fat from a patient who is receiving an augmentation procedure. The fat may be extracted using any suitable surgical syringe or like device. This may for example include a relatively small syringe (e.g., 5 cc volume) or a relatively large syringe (e.g., 60 cc volume), or any size in between (or larger or smaller) depending upon the nature of the donor site, the nature and volume of the augmentation, and any other considerations.

As shown in step 404, the method 400 may include attaching one or more syringes to a centrifuge such as the centrifuge described above. This may include, for example, using a hook or the like on the syringe, or a clip, clamp, or other attachment on the centrifuge flywheel. While a flywheel with holes to secure to syringes is depicted, it will be readily appreciated that a variety of useful attachment techniques may be employed. In general, any form of attachment that either (a) permits a syringe to rotate into a substantially horizontal and radially extending orientation by centrifugation, such as a freely rotating or pivoting attachment or the like, or (b) secures a syringe in a substantially horizontal and radially extending orientation, may be suitable employed to attach syringes as described herein. In one aspect, balanced centrifugation may be achieved by using one or more pairs of substantially equally filled and equally sized syringes on opposing sides of the flywheel, or by providing an equivalent counterweight for a single syringe.

The method may include rotating the centrifuge, as shown in step 406. This may, for example, include turning a crank on the hand-cranked device described above, or providing mechanical force through any other suitable manual, mechanical, and/or electronic means. For example, the centrifuge may include an electrical motor and timer to provide timed centrifugation with a single press of a button. The centrifuge may be rotated for a fixed time (e.g., two minutes), or a time that varies according to syringe volume, tissue types, or any other factor(s). The centrifuge may include an electromechanical system to perform any number of potentially useful related functions such as providing mechanical advantage for higher speed rotation, providing for relatively continuous increases and decreases in speed, preventing rotation beyond a predetermined speed, or otherwise improving centrifugation to achieve desired separation. In general, centrifugation continues until a desired separation of fat from other liquids/materials is achieved.

The method may include removing a syringe from the centrifuge as shown in step 408. After centrifugation with, e.g., the needle end of the syringe away from the flywheel and the plunger end near the flywheel, fat that is less dense than water or other liquids may move by centrifugation toward the plunger end of the syringe. Once a syringe is removed from the centrifuge, the plunger may be pushed to evacuate non-fat materials from the needle end of the syringe, leaving a syringe with injectible fat for any surgical or other use. In other embodiments, the syringe orientation may be reversed so that fat is urged by centrifugation toward the needle end of the syringe. This may pose additional challenges for a surgeon, such as using the separated fat before it begins to mix with other materials and monitoring an injection to ensure that only fat is injected into a surgical site. Nonetheless, this technique may be employed without departing from the scope of this disclosure.

The method may include injecting the fat into a site such as a surgical site as shown in step 410. This may, for example, include a breast enlargement site or any other site suitable for augmentation with fat.

It will be appreciated that the steps described above may be re-ordered, modified, omitted, or supplemented all without departing from the scope of this disclosure. For example, a needle end of a syringe may be sterilized before injection of separated fat, or the needle used to extract fat may be replaced altogether with a different needle for injection. It will also be appreciated that while separation of fat for surgical augmentation is emphasized in this description, the principles of this disclosure may be suitable adapted to any environment where materials might be extracted, separated based upon density, and re-injected with a syringe. All such variations are intended to fall within this description.

Figure 5:
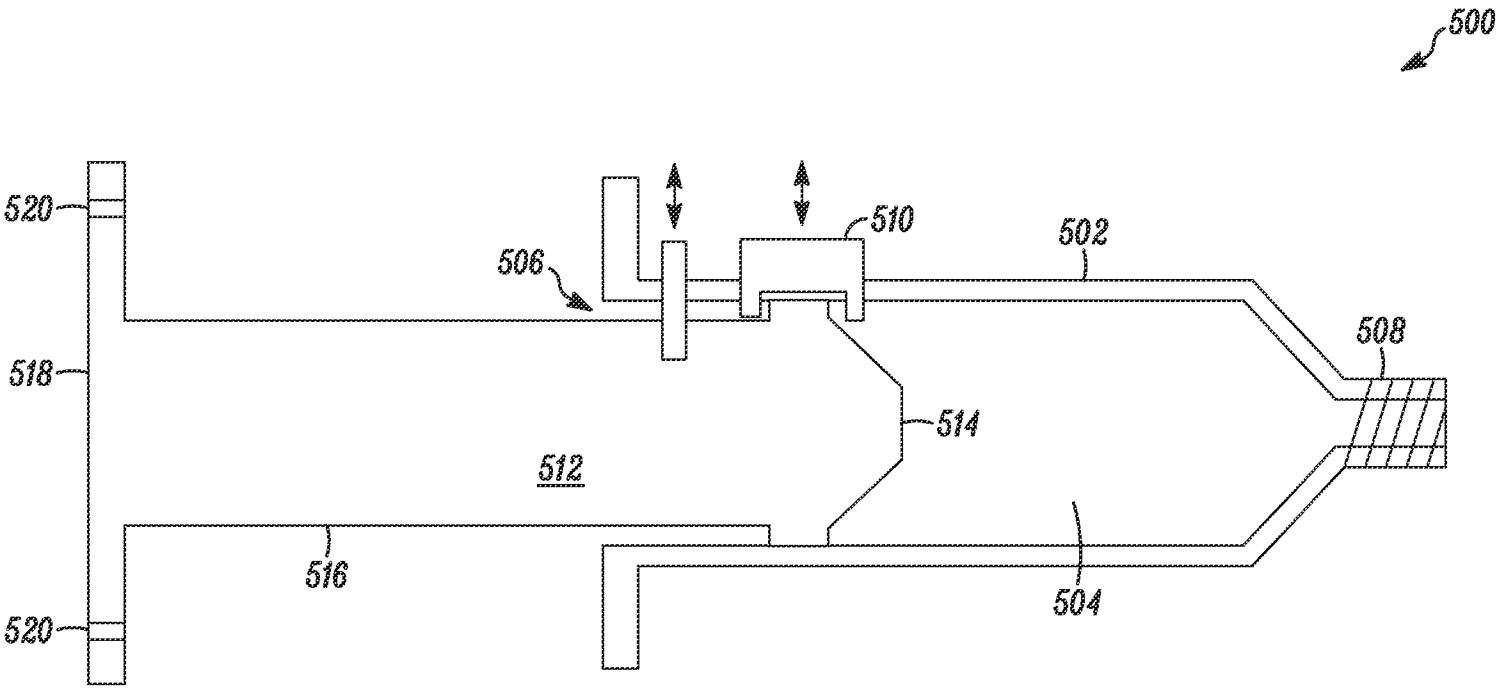
FIG. 5 shows a syringe for use with a syringe centrifuge.

FIG. 5 shows a syringe for use with the centrifuge described herein. In general, the syringe 500 may include a barrel 502 having a lumen 504, an opening 506, a needle attachment 508, and a lock 510, along with a plunger 512 having a seal 514, a stem 516, and a thumb rest 518.

In general, the syringe 500 may serve to extract material into the lumen 504 by operation of the plunger 512 out of the lumen 504 (to the left as depicted), attach to a centrifuge as described in greater detail below, and then evacuate the lumen 504 by depression of the plunger 512 back into the barrel 502. The syringe 500 may have a generally cylindrical shape (i.e., with a circular axial cross section) as typical of syringes known in the art, however this shape is not required. The syringe 500, including the barrel 502 and/or plunger 512 as well as various parts thereof may have a different cross-sectional shape such as oval, rectangular, or any other polygonal or other shape.

The barrel 502 may be formed of any material, such as a biocompatible, clear plastic to permit viewing of biomaterial inside the lumen 504. The barrel 502 may be gradated with printed or raised marking and text indicating volume within the barrel 502. When deployed as a kit or otherwise sold or distributed for use, the barrel 502 may be sterilized and packaged in a sterile container or the like. The barrel 502 may be delivered with the plunger 512 already inserted therein, or plungers and barrels may be delivered separately for use/re-use according to judgment or preference of a medical professional using the device.

The lumen 504 may be of any suitable volume for a particular application. Volumes from 5 cubic centimeters to 60 cubic centimeters and beyond may be usefully employed in cosmetic surgical procedures as contemplated herein. As noted above, material within the lumen 504 may be viewed through a transparent wall of the barrel 502. The opening 506, generally permits insertion/removal of the plunger 512 into the lumen 506. The opening 506 may include an interior rib, flange, or the like that resists passage of the seal 514 into and out of the barrel 502 so that, e.g., the plunger 512 tends to remain within the barrel 502 during use.

The barrel 502 may include a fluid port 530 on an opposing end of the barrel from the opening 506. The fluid port 530 may be for passage of fluid (such as fat) into and out of the lumen, and may generally permit fluid engagement of the lumen 504 to a surgical site, such as where fat is to be removed or injected. The fluid port 530 may include a needle attachment 508 that is threaded or otherwise fitted for attaching, removing, and/or replacing a needle on the end of the barrel 502. The choice of a needle gauge, length, and so forth may depend upon a particular surgical procedure in which the syringe 500 is to be used.

The lock 510 may be any suitable locking mechanism for retaining the plunger 512 in a fixed position relative to the barrel 502. This may include a dowel, pin, or the like that inserts into a mating hole in the plunger 512. The dowel may removably pass through a wall of the barrel 502, or may be mounted in the wall in a manner that seals the contents of the lumen 504 within the barrel 502 while permitting inward and outward motion of the pin, such as to secure and release the plunger 512. In other embodiments, the lock 510 may include a U or fork shape that surrounds or otherwise restrains the seal 510 of the plunger 512. In another aspect, the lock 510 may be internal to the plunger 512, with arms or the like that expand to secure against the interior side(s) of the barrel 502, such as by depressing a button or the like on the thumb rest 518. Still more generally, it will be understood that a wide variety of locking mechanisms are known in the mechanical arts, and may be suitably adapted to secure the plunger 512 in relation to the barrel 502. By securing the barrel 502 and plunger 512 in this or any similar manner, the syringe 500 may be secured by its end to a centrifuge and centrifuged without the barrel 502 releasing from the plunger 512 due to the forces of the centrifugation.

While a lock 510 is one suitable mechanism for securing the plunger to the barrel during centrifugation, it will be appreciated that other techniques may also, or instead be employed. For example, the opening 506 of the barrel may be fabricated to have a substantially smaller inner diameter than an outer diameter of the seal 514, thus physically preventing separation of the barrel and plunger. While this approach may prevent fabrication, distribution, and clinical use as separate parts, it advantageously mitigates undesired separation of a barrel and plunger due to improper use of a locking mechanism such as the lock 510. Similarly, a tether or the like may secure the seal to the interior of the lumen 504 nearest to the needle attachment point 508. Thus it will be appreciated that a variety of techniques may be used instead of, or in addition to, the lock 510 to retain the plunger securely in the barrel 502 during centrifugation.

The barrel 502 may also include finger rests, flanges, or the like near the opening 506 to provide a point to manually apply pressure contrary to the thumb rest 518 when evacuating material from the lumen 504 during a procedure. In one aspect, barrel may be attached directly to a centrifuge, such as with a hinged or other rotating attachment including in, or attached to the finger rests, or otherwise positioned near the opening 506 end of the barrel 502.

The plunger 512 may be formed of any suitable material, such as a rigid plastic or the like. The stem 516 should be sufficiently rigid to deliver force to evacuate the lumen 504 or to extract the plunger 512 from the barrel 502 during ordinary use.

The seal 514 may include any suitable seal for slidably engaging an interior wall of the barrel 502 and keeping material within the lumen 504. This may include, for example, a soft rubber with a number of ribs, fins or the like that contact an interior wall of the barrel 502 (while permitting movement of the plunger 512 within the barrel 502). The seal 514 may also include a rigid portion that is retained within the barrel 502 by a rigid rib, flange, tab or the like on the interior wall of the barrel 502 near the opening 506 end thereof. The seal 514 may also include one or more holes, ridges, tabs, protrusions, or the like where the lock 510 can engage the seal 514 to prevent axial movement of the plunger 512.

The thumb rest 518 may be a disk or the like suitably positioned, shaped and sized for an application of thumb force to the plunger 512 to evacuate material from the lumen 504 of the barrel 502. In one aspect, the thumb rest 518 may include one or more holes 520 or other openings fabricated directly into the thumb rest 518 so that the plunger 512 can be hingeably secured to a centrifuge, e.g., on a hook or the like. These holes may be molded into the plunger 512 during fabrication, or pre-drilled into the thumb rest 518 (or similar plunger end) after the plunger 512 is fabricated using a casting or molding process. The thumb rest 518 may include any number of such holes. As depicted, these holes may be substantially parallel to a central axis of the syringe 500. It will be understood that the hole(s) may also or instead be placed at any suitable angle for use as described herein. In another aspect, a tab, post or the like may extend from a top of the thumb rest 518, with a hole drilled (or otherwise fabricated) in an orientation perpendicular to the central axis of the syringe 500.

In another aspect, the plunger 512 may include an aspirator or the like for extracting material through the plunger 512 or seal 514 from the opening 506 end of the barrel 504. In this manner, more complex substances that separate into multiple layers may be selectively extracted from the lumen 504 at the top or bottom (when the center axis is oriented vertically), thus permitting any desired layer of centrifuged material to be retained within the syringe 500.

It will be understood that the centrifuge described herein may also be adapted for use with other syringes. For example, a conventional plunger with a planar thumb rest may be employed, and a corresponding fork or other attachment point may be provided on the centrifuge. The attachment point may be hinged or otherwise secured to the flywheel of the centrifuge to permit rotational or universal movement so that the syringe can swing outward during a centrifugation process (thus orienting the axis of the syringe to the centrifugal loading applied by the centrifuge). In another aspect, the flywheel may be adapted to connect to a syringe with a thumb loop or the like in a manner that securely attaches the syringe to the flywheel while permitting rotation of the syringe during centrifugation.

Other ergonomic features for a syringe are known and may be incorporated into the syringe 500 described above. For example, a large, padded thumb pad may be employed on the thumb rest 518. A non-slip finger grip or the like may be used around the opening of the barrel for more secure manipulation of the syringe during use. An oval barrel may be used to prevent spinning of the barrel in a surgeon's fingers during use. All such variations are intended to fall within the scope of this disclosure.

In another aspect, disclosed herein are kits for use in the centrifugation procedures described above including for example various combinations of needles, plungers, syringe barrels, and centrifuge attachment hardware for attaching any of the foregoing to a flywheel or similar centrifuge mechanism. In particular, useful kits may include various disposable elements such as one or more barrels, plungers, needles, and the like adapted for use with a centrifuge described above. A kit may also include directions for use, disposal, and so forth.

Figure 6:
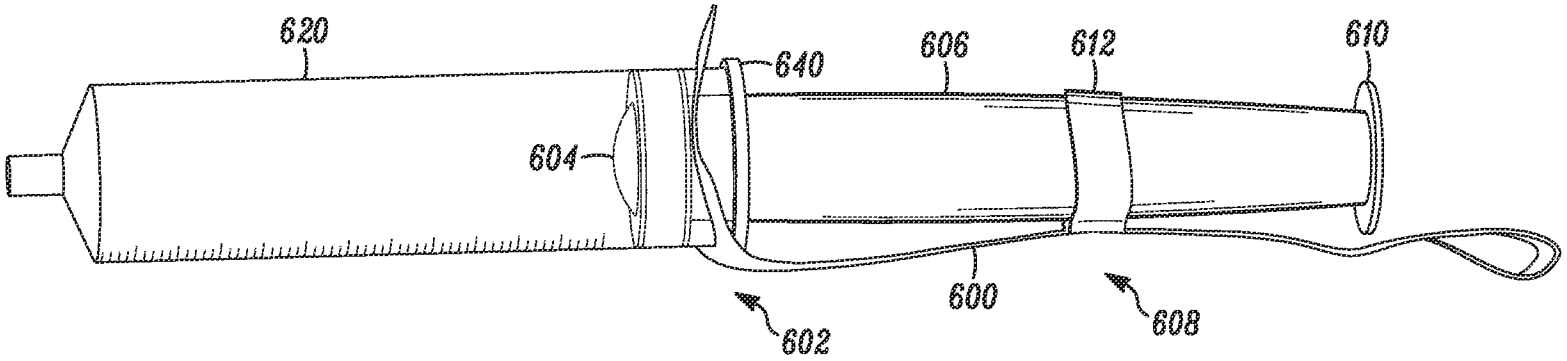
FIG. 6 shows a syringe holder.

FIG. 6 shows a syringe holder. As depicted, the syringe holder 600 may include an end support 602 near a first end 604 of the plunger 606 away from the flywheel (e.g., pointed out during centrifugation) and/or plunger support 608 toward a second end 610 of the plunger 606 that extends out from the barrel 620 of the syringe.

The plunger support 608 may include a plunger clasp 612 having fingers or the like that removably and replaceably engage the plunger 610. The plunger clasp 612 may for example, include a hook-and-loop fastener such as Velcro that wraps around the plunger 610. Other embodiments include metal or plastic fingers that springably engage the plunger 610 in a secure but removable fashion, or a band with a snap or other fastener to circumferentially secure the plunger 610 to the syringe holder 600 at a point along the length of the plunger 610 where it is outside the barrel 620 of the syringe. While the plunger clasp 612 is depicted as a clamp or band for securing the plunger 610, it will be understood that other securing mechanisms may similarly be employed. For example, the plunger 610 may include a through-hole somewhere along its length positioned to engage a tab or other protrusion from the syringe holder 610. The plunger 610 may also or instead include a tab or protrusion (e.g., from a flat surface, but within the cross-sectional interior of the barrel so that it does not interfere with movement of the plunger 610 into the barrel during normal use) and the syringe holder 610 may include a hole that fits over the tab, or optionally a series of holes so that the plunger 610 can be secured at a number of positions along its length, or so that it can be secured in a number of different positions relative to the barrel 620.

The syringe holder 600 may also include a flywheel attachment 630, which may be a loop, hook, snap, flange (where the flywheel has a suitable corresponding receptacle), or any other attachment mechanism to removably and replaceably secure the syringe holder 600 to a flywheel, or to a hinged fixture of a flywheel, in a manner that permits the barrel 620 to rotate radially outward during centrifugation. The end support 602 may include a forked or open end that fits around the barrel 620 of the syringe and engages the flanges 640 on the open end of the barrel 620. The flanges 640 may be convention finger grips of a surgical syringe or flanges specifically adapted to securely rest within the end support 602. The end support 602 may instead include a hole that completely encircles the barrel 620.

In general, the barrel 620 may contain biomaterial such as extracted fat and other tissue. The mass of this biomaterial will tend to move the barrel 620 away from the flywheel at the end support 602. The additional plunger support 608 may serve to retain the barrel 620 and plunger 610 in the syringe holder 600, and to retain the entire syringe in alignment with the syringe holder 600 throughout a centrifugation process. Thus the end support 602 and plunger support 608 may cooperate to secure the entire syringe assembly in a manner that prevents or inhibits relative movement between the two components during handling, such as while the syringe is being centrifuged.

The syringe holder 600 may be shaped and sized for different sized syringes. For example, the syringe holder 600 may be sized to securely hold a 5 cc syringe barrel, a 60 cc syringe barrel, or a barrel of some other size.

Figure 7:
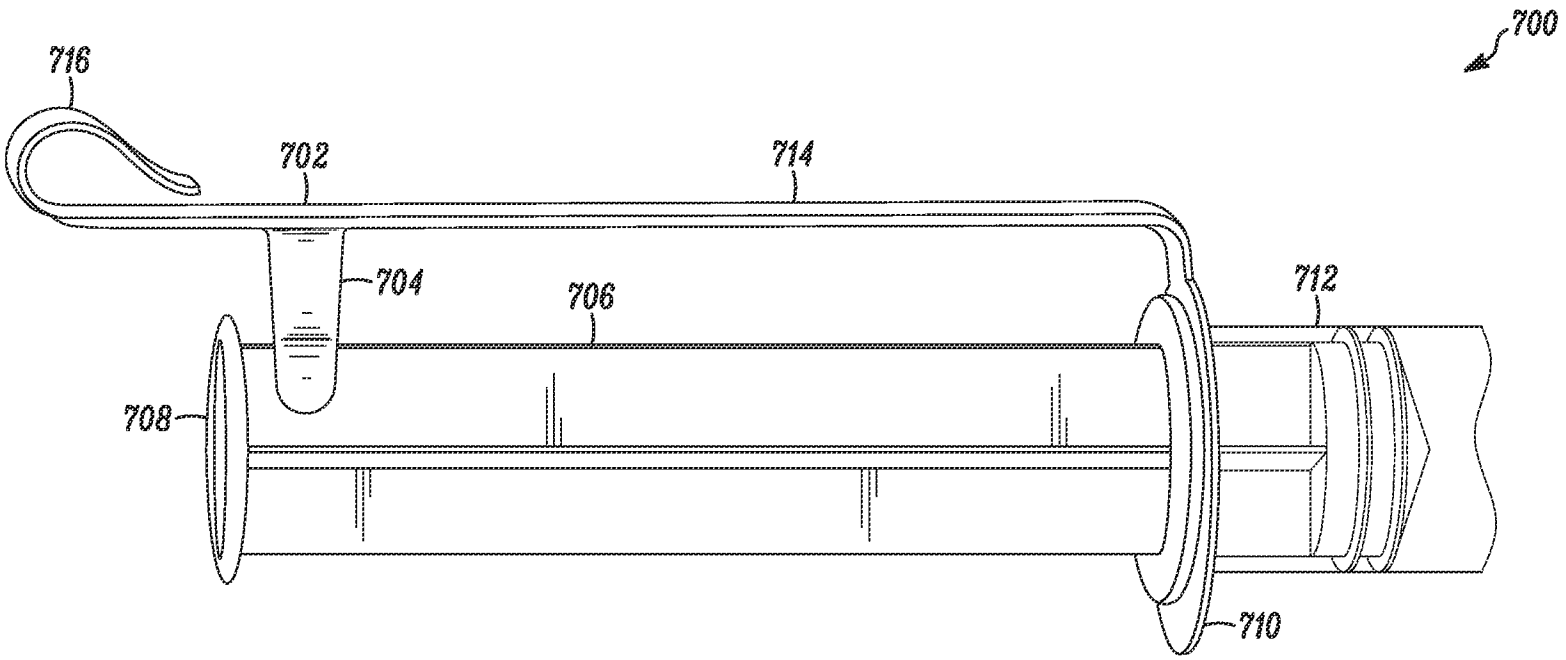
FIG. 7 shows a syringe holder.

FIG. 7 shows a syringe holder. The syringe holder 700 may in general be any of the syringe holders described above. In the embodiment of FIG. 7, a plunger support 702 includes a pair of fingers 704 that grip a planar support structure 706 of a plunger 708. In this configuration, the plunger 708 may be conveniently rotated about an end support 710 into and out of the syringe holder 700 during use. The end support 710 may form a closed circle into which the barrel 712 may be inserted. In the embodiment of FIG. 7, an arm 714 extends from the end support 710 to the plunger support 704, and further to a flywheel attachment 716, which may be any of the attachments described above. It will be appreciated that the plunger support 702 secures a plunger at any point along its length. In the embodiment of FIG. 7, the plunger support 702 is positioned to secure the plunger at an end of its fully retracted length.

Figure 8:
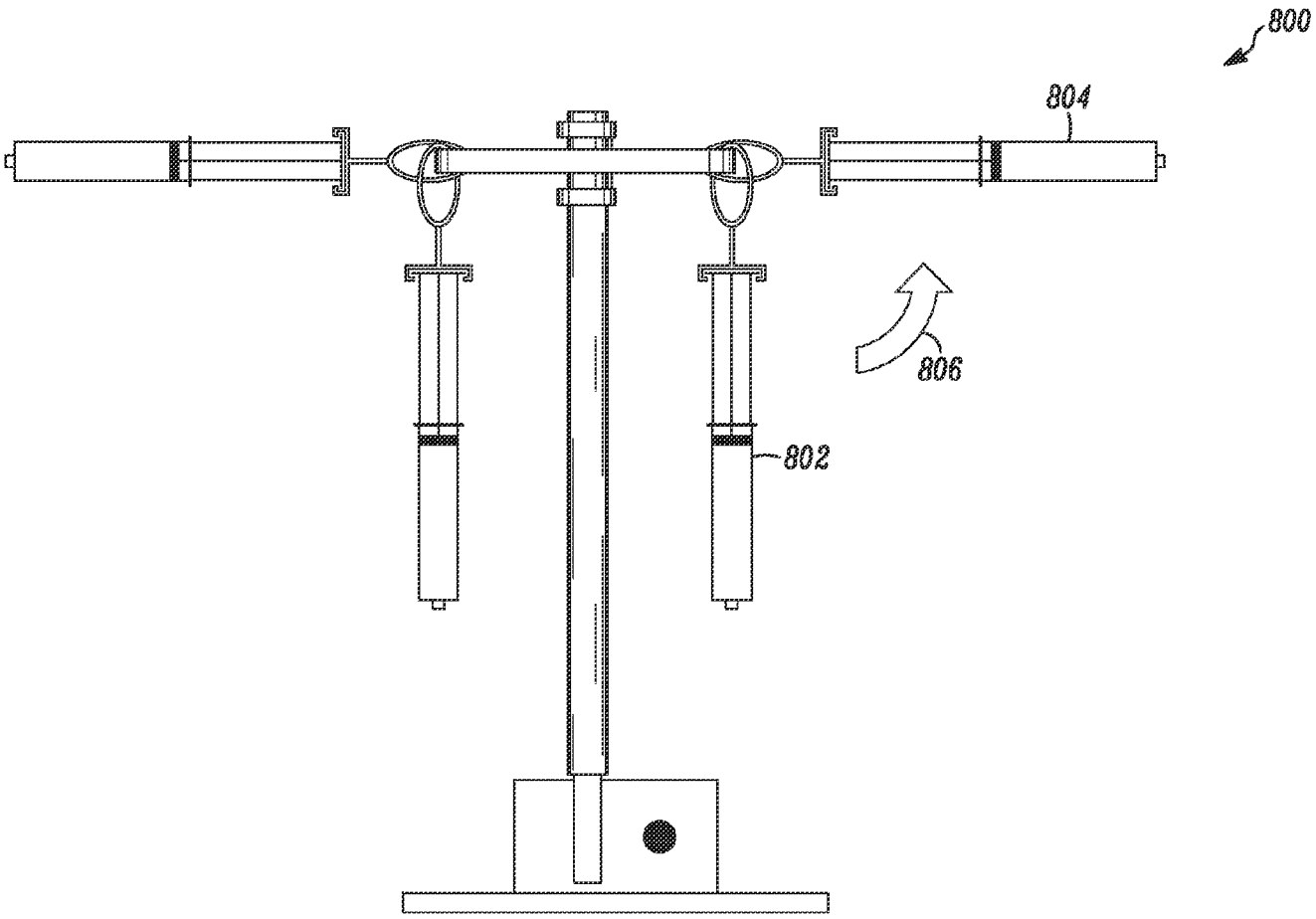
FIG. 8 illustrates the movement of a number of syringes on a syringe centrifuge during centrifugation.

FIG. 8 illustrates the movement of a number of syringes on a syringe centrifuge during centrifugation. The syringe centrifuge 800 may, for example, be any of the centrifuges described above. The syringes generally move from a more vertical orientation 802 when the centrifuge is still to a more horizontal orientation 804 under the force of centrifugation, as indicated by an arrow 806. In this manner force is applied to the contents of the syringe barrel so that denser materials move toward the bottom of the barrel or away from the center of the centrifuge. In the applications described herein, this process may be used for example to separate fat from other fluids and material that might be collected from a surgical site with the syringe and/or other surgical tools. In an embodiment, the syringes may be rotated at about 300 to 400 revolutions per minute during centrifugation.

The syringe centrifuge 800 may contain gears or other mechanical couplings as described above to deliver, e.g., 300-600 revolutions per minute at a hand-crank rate of about two cranks (or rotations) per second. With this gearing ratio, the syringe centrifuge may deliver up to eight 60 cc syringes of decanted fat over 2-3 minutes resulting in G forces of 20-60 G. This is in comparison to 1000-1300 G placed on adipocytes during conventional machine centrifugation using 10 cc syringes. Thus, in one embodiment as described herein, about 480 cc of decanted fat can be processed in 2-3 minutes.

Figure 9:
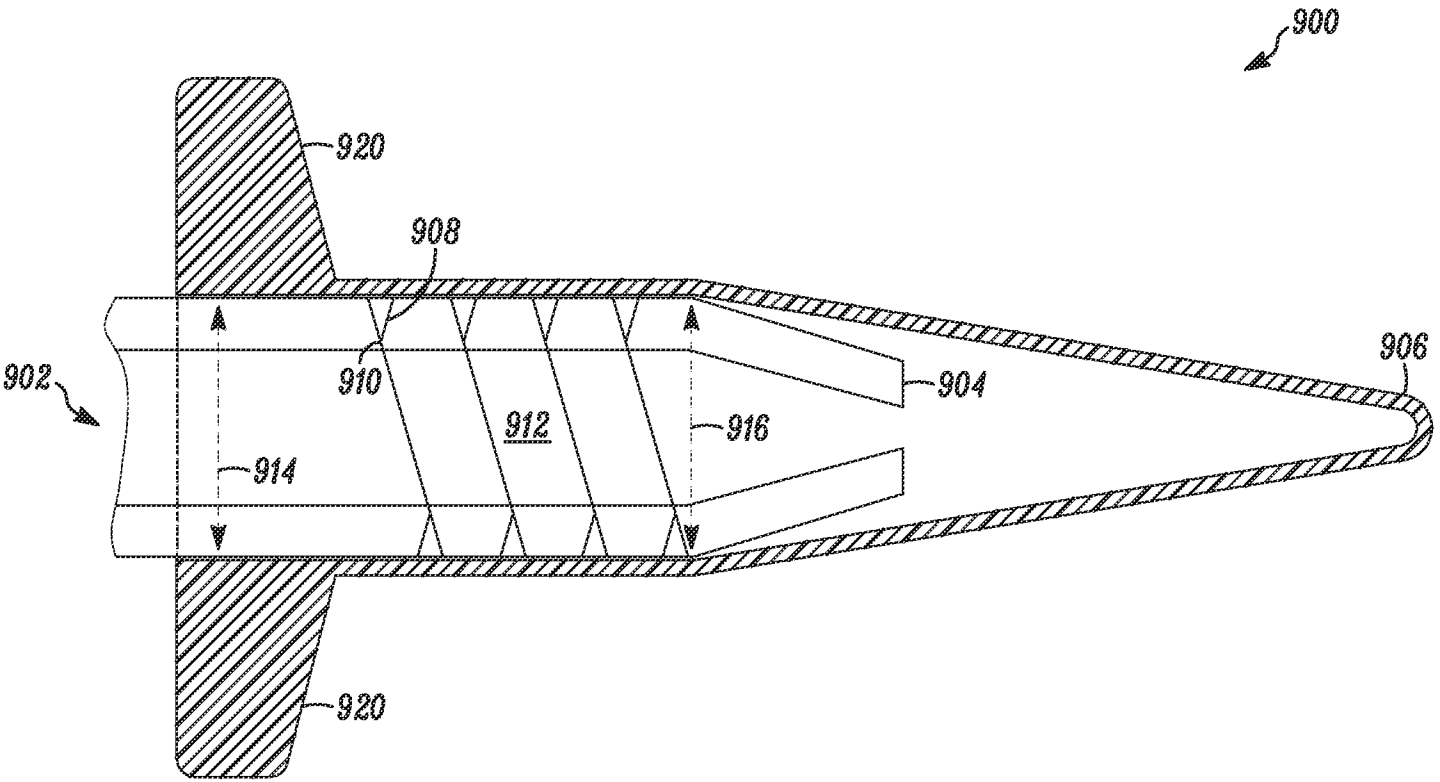
FIG. 9 shows a cross section of a cap for a syringe.

FIG. 9 shows a cross section of a cap for a syringe. In surgical processes as contemplated herein, a syringe may be capped and uncapped several times. Where the syringe contains a material such as a fat, the material may tend to lubricate friction fits or the like that retain a cap for the syringe, particularly where the material extrudes out of the barrel and onto exterior regions of the syringe tip. This may result in poor capping strength that is unsuitable for centrifugation of other handling. In order to address the shortcomings of existing syringe caps in containing such fatty materials, a threaded cap may be employed.

In general, a cap 900 may have an open end 902 that fits about a tip 904 of a syringe, and a closed end 906 opposing the open end 902 that retains material within the syringe when the cap 900 is secured to the tip 904. The cap 900 may be fabricated of stainless steel, aluminum or any other material that is biocompatible and/or sterilizable, and that is sufficiently hard to cut a plastic material of the tip 904 as described below. In one aspect, the cap 900 may be autoclavable for reuse. In another aspect, the cap 900 may be disposable.

The cap 900 may include a thread 908 disposed on an interior 912 of the cap 900 having a crest 910 that is pointed or otherwise brought to a sharp edge sufficient to cut into a tip 906 of a syringe 908. Thus, the cap 900 can be screwed over the tip 906 and tightened to create grooves in the tip 906 to overcome any lubrication effects of material within the syringe 908. In an embodiment, the cap 900 may be fabricated from a material such as a transparent plastic, and the thread 908 may be formed of a helical stainless steel element inserted into the cap 900 in a fabrication process.

The interior 912 of the cap 900 may be tapered along the threaded region (from where the thread begins to where it ends) so that a first diameter 914 toward the open end 902 is greater than a second diameter 916 toward the closed end 906 in order to improve error tolerance (in dimensions of the tip 906) and fit as the cap 900 is screwed on to the tip 906.

The cap 900 may include one or more tabs 920 that provide finger grips for tightening the cap 900 on to the tip 904. The tabs 920 may, for example, include two opposing tabs, which may be positioned, shaped, and sized for operation with a thumb and index finger.

By tightening the cap 900 with a sharp-crested steel thread about a tip of a syringe, the cap can score or otherwise cut in to the plastic tip to create a secure mechanical fit regardless of materials such as fat that might be disposed about the tip as a result of handling.

Figure 10:
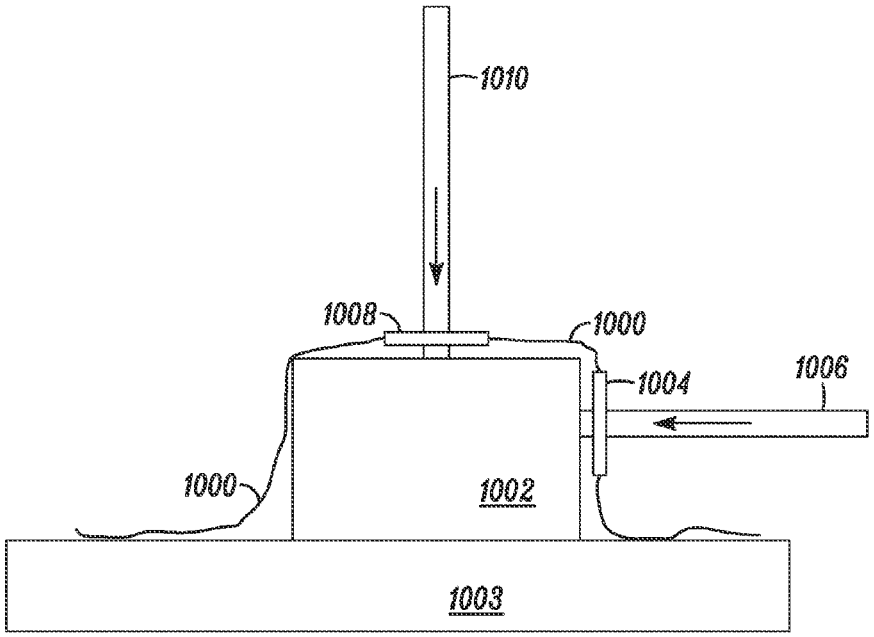
FIG. 10 shows a sterilization barrier for a centrifuge

FIG. 10 shows a sterilization barrier for a centrifuge. A barrier 1000, which may be formed of a sheet of material such as cloth, other fabric, or a flexible film. The barrier may be shaped to fit about a gearbox 1002 of a hand-cranked centrifuge. This may be a loose fit that drapes over the gearbox to accommodate various sizes of gearboxes and permit easy placement and removal of the barrier 1000. In general, the barrier 1000 may be a sterilizable material to permit re-use, or a disposable material that is provided for use in a sterile package. The barrier 1000 may be sized to extend beyond the gearbox 1002 a sufficient distance along a working surface 1003 to form a sterile barrier between the gearbox 1002 and the surrounding environment, or the barrier 1000 may extend below the gearbox 1002 to envelope the gearbox 1002 in the barrier 1000. Zippers, snaps or the like may be provided to secure the barrier 1000 about the gearbox 1002 in any desired fashion.

The barrier 1000 may include a first opening 1004 for a crankshaft 1006, which may be any of the crankshafts described above. The first opening 1004 may be reinforced to prevent wear on the barrier 1000 by rotation of the crankshaft 1006. The first opening 1004 may also or instead include a seal such as a gasket or the like, and/or the first opening 1004 may include a bearing. Thus in one aspect the first opening 1004 includes a gasket that fits securely to the crankshaft 1006, held by a bearing that permits the gasket to rotate freely with the crankshaft 1006. The first opening 1004 may also include a zipper, or a flap that can open and close about the crankshaft 1006 when the barrier 1000 is being placed or removed.

The barrier 1000 may include a second opening 1008 for a driveshaft 1010, which may be any of the driveshafts described above. The second opening 1008 may be reinforced to prevent wear on the barrier 1000 by rotation of the driveshaft 1010. The second opening 1008 may also or instead include a seal such as a gasket or the like, and/or the second opening 1008 may include a bearing. Thus in one aspect the second opening 1008 includes a gasket that fits securely to the driveshaft 1010, held by a bearing that permits the gasket to rotate freely with the driveshaft 1010. The second opening 1008 may also include a zipper, or a flap that can open and close about the driveshaft 1010 when the barrier 1000 is being placed or removed.

In operation, the gearbox 1002 may be placed on the working surface 1003 without the driveshaft 1010 or crankshaft 1006 inserted therein. The barrier 1000 may be sterilized, and then placed over the gearbox 1002 to enclose the gearbox 1002 in a sterile field. The driveshaft 1010 and crankshaft 1006, which may also be sterilized, may then be inserted into the corresponding openings 1008, 1004 in the barrier 1000 and engaged to the gearbox 1002 as described in greater detail above. In this manner, the centrifuge may be used in environments requiring sterilization, without separately requiring that the gearbox 1002 be sterilized. This approach can advantageously reduce or eliminate the sterilization regime required for the gearbox 1002, which may have complex mechanical parts and lubrication that are unsuitable for steam sterilization and the like.

While the invention has been disclosed in connection with the preferred embodiments shown and described in detail, various modifications and improvements thereon will become readily apparent to those skilled in the art. Accordingly, the spirit and scope of the present invention is not to be limited by the foregoing examples, but is to be understood in the broadest sense allowable by law.

What is claimed is:

1. A centrifuge comprising:

a base plate;

a gearbox coupled to the base plate that transfers rotation of a crankshaft to a driveshaft, wherein the crankshaft is a sterilizable crankshaft removably and replaceably coupled to the gearbox and wherein the driveshaft is a sterilizable driveshaft removably and replaceably coupled to the gearbox;

a flywheel coupled to the driveshaft through a clutch, the flywheel having a perimeter and a plurality of attachment points distributed near the perimeter, each attachment point having a syringe retainer configured to directly receive and hold a syringe by a plunger end thereof, each attachment point further adapted to hingeably support the syringe in a manner that permits a rotation of the syringe radially outward from the flywheel during centrifugation, wherein the syringe retainer further comprises a hook in each attachment point hole shaped to retain the plunger end of the syringe; and an attachment mechanism that secures the base plate to a working surface.

2. The centrifuge of claim 1 wherein the base plate is formed of stainless steel.

3. The centrifuge of claim 1 wherein the gearbox provides a gearing ratio from the crankshaft to the drive shaft of about 1:5.

4. The centrifuge of claim 1 further comprising a display that provides visual feedback to a user concerning operation of the centrifuge.

5. The centrifuge of claim 4 wherein the display provides a numerical indication of rpm of the centrifuge.

6. The centrifuge of claim 4 wherein the display is an electronic display.

7. The centrifuge of claim 6 wherein the electronic display is powered by conversion of energy from the crankshaft.

8. The centrifuge of claim 4 wherein the display operates mechanically to provide centrifuge status information to the user.

9. The centrifuge of claim 1 wherein the clutch is a freewheeling clutch that permits continued rotation of the flywheel when the driveshaft rotates more slowly than the flywheel.

10. The centrifuge of claim 1 wherein the clutch includes a power take-off that prevents the centrifuge from exceeding a predetermined rotational velocity.

11. The centrifuge of claim 1 wherein the driveshaft is keyed to the gearbox and secured to the gearbox with at least one of a clevis fastener and a cotter ring.

12. The centrifuge of claim 1 wherein the crankshaft is keyed to the gearbox and secured to the gearbox with at least one of a clevis fastener and a cotter ring.

13. The centrifuge of claim 1 wherein each attachment point of the flywheel includes a hole.

14. The centrifuge of claim 1 wherein the hook in each attachment point hole includes a lock to secure the plunger during centrifugation.

15. The centrifuge of claim 1 wherein the plurality of attachment points include eight attachment points.

16. The centrifuge of claim 1 wherein the attachment mechanism includes a clamp.

17. The centrifuge of claim 1 wherein the attachment mechanism includes at least one suction cup.

18. The centrifuge of claim 1 wherein the flywheel has a diameter of about 12 cm.

19. The centrifuge of claim 1 wherein the crankshaft is powered by a foot pedal.

* * * * *